US005479195A

United States Patent [19]

Takagi

[11] Patent Number: 5,479,195

[45] Date of Patent: Dec. 26, 1995

[54] IMAGE FORMING APPARATUS AND METHOD

[75] Inventor: Osamu Takagi, Nagoya, Japan

[73] Assignee: Brother Kogyo Kabushiki Kaisha, Nagoya, Japan

[21] Appl. No.: 321,036

[22] Filed: Oct. 3, 1994

[30] Foreign Application Priority Data

Nov. 4, 1993 [JP] Japan ..... 5-275501

[51] Int. Cl.[6] ..... B41J 2/06

[52] U.S. Cl. ..... 347/55

[58] Field of Search ..... 355/245, 261, 355/262; 118/647, 648, 653; 347/55, 158

[56] References Cited

U.S. PATENT DOCUMENTS

| | | | |
|---|---|---|---|
| 3,689,935 | 9/1972 | Pressman et al. | 347/55 |
| 4,743,926 | 5/1988 | Schmidlin et al. | 347/55 |
| 4,755,837 | 7/1988 | Schmidlin et al. | 347/55 |
| 4,780,733 | 10/1988 | Schmidlin | 347/55 |
| 4,814,796 | 3/1989 | Schmidlin | 347/55 |
| 4,912,489 | 3/1990 | Schmidlin | 347/55 |
| 5,036,341 | 7/1991 | Larsson | 347/55 |
| 5,170,185 | 12/1992 | Takemura et al. | 347/55 |

*Primary Examiner*—William J. Royer
*Attorney, Agent, or Firm*—Oliff & Berridge

[57] ABSTRACT

An image forming apparatus uses toner whose degree of dispersion is set in a range of 1.0 to 1.15 (the degree of dispersion is defined as a value that is obtained by dividing an average particle diameter obtained from a particle-diameter distribution on the basis of the volume of the toner by an average particle diameter obtained from a particle-diameter distribution on the basis of the number of particles of the toner). The apparatus includes a toner carry roller for carrying the toner thereon and a toner-layer restricting blade that is disposed in contact with the toner carry roller and serves to restrict the carried toner to be a single layer. Sufficient density contrast can be obtained with a low driving voltage.

21 Claims, 6 Drawing Sheets

IMAGE FORMING APPARATUS AND METHOD

BACKGROUND OF THE INVENTION

1. Field of the Invention

The present invention relates to an image forming apparatus and method that is suitably usable for a copying machine, a printer, a plotter, a facsimile machine, or the like.

2. Description of Related Art

One image forming apparatus that has been conventionally known is disclosed in U.S. Pat. No. 3,689,935 in which an electrode having plural openings (hereinafter referred to as "apertures") is used, and a voltage is applied to the electrode in accordance with image data to control passage of toner particles through the apertures, whereby an image is formed on a supporter (image receiving medium) with toner particles that have past through the apertures.

The image forming apparatus includes an aperture electrode unit comprising an insulating flat plate, a reference electrode-formed continuously on one surface of the flat plate, plural control electrodes that are formed on the other surface of the flat plate and that are electrically insulated from one another, and at least one row of apertures each of which is formed in correspondence with each control electrode so as to penetrate through the flat plate, the reference electrode and the control electrodes. The image forming apparatus also includes structure for selectively applying a voltage across the reference electrode and the control electrodes, structure for supplying charged toner particles so that the flow of the toner particles passed through the apertures is modulated in accordance with the applied voltage, and structure for moving a supporter and the aperture electrode unit relative to each other to position the supporter in a particle flow passage.

U.S. Pat. Nos. 4,743,926, 4,755,837, 4,780,733, and 4,814,796 disclose image forming devices having an aperture electrode unit disposed so that control electrodes face a supporter and a reference electrode faces a toner supply side.

On the other hand, U.S. Pat. No. 4,912,489 discloses an aperture electrode unit disposed so that the reference electrode faces the supporter, and the control electrodes face the toner supply side. The reference describes that a voltage to be applied to the control electrodes at an off-time can be reduced to about a quarter of that of the image forming apparatus as disclosed in the above-mentioned patents.

The term "off-time" means a time when no toner particle is attached onto the supporter, that is, when a blank portion of an image is formed on the supporter, and conversely, the term "on-time" means a time when a toner image is formed on the supporter.

However, in the conventional image forming apparatus as described above, the voltage difference between the control voltages at the on-time and at the off-time (which is referred to as "driving voltage") is driven by an integrated circuit, and thus, it is preferably set to a small value. Practically, it must be set to 50 V or less. The relationship between the control voltage to be applied to the control electrodes and the density of an image formed on a supporter (image receiving medium) is shown as indicated by a dotted line in FIG. 4A. Even when the control voltages at the on-time and at the off-time are set to any values while maintaining the driving voltage at 50 V, it has been impossible to perform such a printing operation with the image density above 1.5 at the on-time and below 0.07 at the off-time without fog.

For various reasons, in the relationship between the control voltage and the image density as shown in FIG. 4A, when a plus voltage is applied to the control electrodes at the on-time to generate toner flow, the toner flow is generated in accordance with the control voltage. Conversely, when a minus voltage is applied to the control electrodes at the off-time, no toner flow is generated in accordance with the control voltage.

For example, as indicated by the dotted line of FIG. 4A, when the control voltage at the on-time is set to 70 V and the control voltage at the off-time is set to 20 V, the image density above 1.5 is obtained at the on-time, which is a sufficient value. At the off-time, image fog occurs, and thus, the image density is not sufficiently reduced, and image quality is deteriorated. On the other hand, when the control voltages at the on-time and at the off-time are set to 30 V and −20 V, respectively in order to suppress the image fog, the image fog is suppressed at the off-time, and the image density is sufficiently reduced to about 0.07, which corresponds to the density of a sheet (background). However, the image density at the on-time becomes insufficient, and thus, the image quality is deteriorated.

The relationship between the control voltage and the image density should be stepwisely (binary) varied at a threshold voltage as indicated by a solid line of FIG. 4B, and in this case, the control voltage can be reduced to an extremely small value. However, there is a dispersion of various toner characteristics such as the charge amount, particle diameter, etc. of individual toner particles to be supplied to the toner particle control means. Therefore, when the respective toner particles that are dispersed having the toner characteristics as described above are bundled into toner flow as a whole, the actual relationship between the control voltage and the image density is shown by a dotted line in FIG. 4A, and thus, the control voltage is increased.

Further, if the adhering force between the toner and the carrier is made uniform, the density curve shown in FIG. 4A could approach the ideal curve as described above, and it is effective to carry the toner as a single layer on the carrier. However, in this case, the toner directly suffers an effect of dispersion in the particle diameter, the charge amount, the weight, etc. of the toner because it is a single layer, and thus, a more uniform characteristic is required for the toner to efficiently approach the ideal density curve. In a case of toner that is manufactured with a grinding method or the like and used for an electrophotographic apparatus or the like, the degree of dispersion of the toner is set to about 1.3 to 1.4. The degree of dispersion is defined as a value that is obtained by dividing an average particle diameter obtained from a particle-diameter distribution on the basis of the toner particle volume by an average particle diameter obtained from a particle-diameter distribution on the basis of the toner particle number.

For example, in FIG. 7, a distribution X at the left side of FIG. 7 represents a particle-diameter distribution on the basis of the number of particles, and a distribution Y at the right side of FIG. 7 represents a particle-diameter distribution on the basis of the volume of the particles. The average particle diameter obtained from the particle-diameter distribution X is equal to 7 μm, and the average particle diameter obtained from the particle-diameter distribution Y is equal to 9.5 μm. That is, these average particle diameters are inconsistent with each other, and thus, the toner characteristic is not uniform carrying the toner as a single layer.

SUMMARY OF THE INVENTION

An object of the present invention is to provide an image forming apparatus and method in which sufficient density contrast can be obtained with a low driving voltage.

An image forming apparatus according to the present invention includes a toner flow controller for controlling a flow of charged toner particles, and a toner supply device for supplying toner particles to the toner flow controller, wherein the degree of dispersion of the toner particles is set in a range of about 1.0 to 1.15, the degree of dispersion being defined as a value that is obtained by dividing an average particle diameter obtained from a particle-diameter distribution on the basis of the toner volume by an average particle diameter obtained from a particle-diameter-distribution on the basis of the toner particle number.

According to the image forming apparatus of the present invention thus constructed, the toner flow controller controls the flow of the charged toner particles, and the toner supply device supplies the toner particles to the toner flow controller. With respect to the used toner particles, the degree of dispersion of the toner particles is set to about 1.0 to 1.15.

As is apparent from the foregoing, the image forming apparatus of this invention uses the toner particles whose degree of dispersion (as defined above) is set in the range of about 1.0 to 1.15, and the toner supply device includes a toner carrier for carrying the toner particles as a single layer thereon and supplying the toner particles to the toner flow controller, whereby the toner flow generation efficiency can be improved, and an image having sufficient density contrast can be obtained with a low driving voltage.

BRIEF DESCRIPTION OF THE DRAWINGS

A preferred embodiment of the present invention will be described in detail with reference to the following figures, wherein.

DETAILED DESCRIPTION OF PREFERRED EMBODIMENTS

A preferred embodiment according to this invention will be described with reference to the accompanying drawings.

Figure 1:
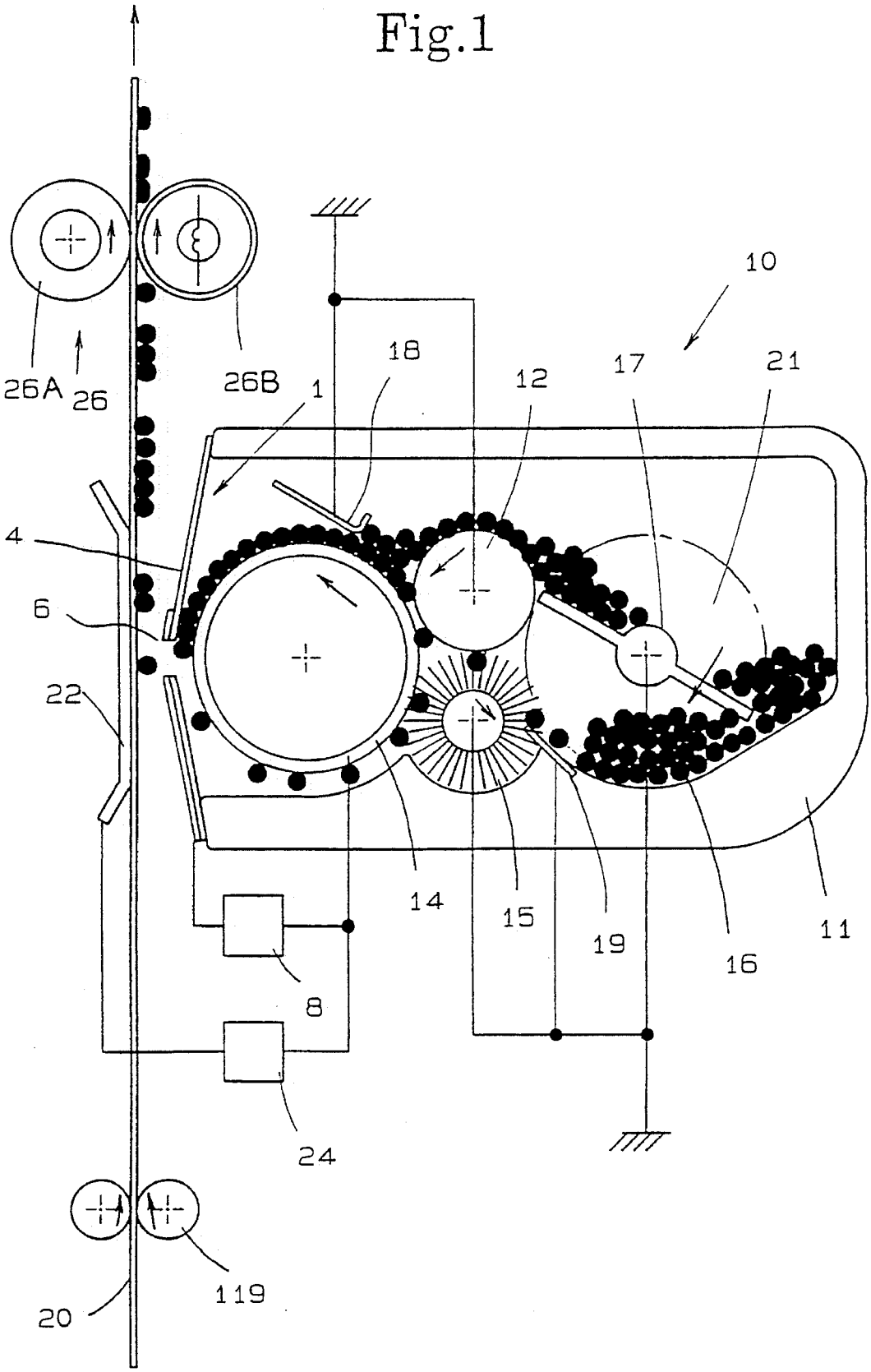
FIG. 1 is a diagram showing the construction of an image forming apparatus of the invention.

FIG. 1 schematically shows an image forming apparatus according to this invention. A back electrode plate 22 is supported by a chassis (not shown) at the left side of an aperture electrode unit I so as to be spaced about 1 mm from the aperture electrode unit 1. A pair of feeding rollers 119 are disposed below the back electrode plate 22 to feed an image receiving medium 20 and insert the image receiving medium 20 into the 1 mm gap. A toner supply device 10 is disposed along the longitudinal direction of the aperture electrode unit 1 at the right side of the aperture electrode unit 1, and a fixing device 26 is disposed downstream in a feeding path of the image receiving medium 20, which is fed past the back electrode plate 22.

Next, the construction of each element will be described in detail.

The toner supply device 10 includes a toner case 11 that also serves as a housing for the device, toner 16, which is stocked into a toner sink 21 in the toner case 11, a toner supply roller 12, a toner carry roller 14, a toner withdrawing roller 15, a toner-layer restricting blade 18, a withdrawing blade 19 and an agitator 17. The toner carry roller 14 carries the toner 16 thereon and feeds the toner to the aperture electrode unit 1. The toner supply roller 12 supplies the toner 16 to the toner carry roller 14. The withdrawing roller 15 comprises a stainless steel shaft where a nylon brush cloth is adhered and serves to peel the residual toner off the carry roller 14. The unused toner and the toner withdrawn by the withdrawing roller 15 are mixed with each other in the toner sink 21 and agitated by the agitator 17.

Figure 5:
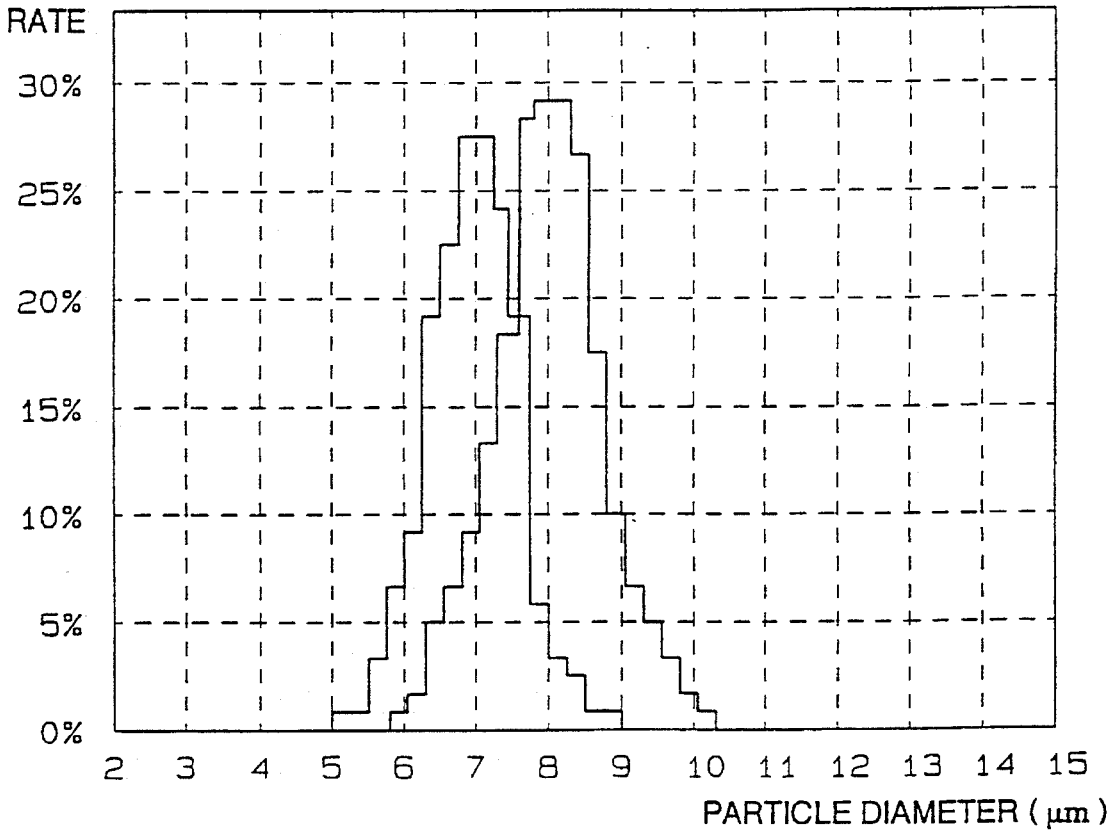
FIG. 5 is a graph showing a particle-diameter distribution of toner used in the image forming apparatus.

As is apparent from the distributions (peaks) at the right and left sides of FIG. 5, the particle diameter distribution based on the number of the toner particles and the particle diameter distribution based on the volume of the toner particles are substantially uniform, and the degree of dispersion (defined above) is set in the range of about 1.0 to 1.15. In this case, the average particle diameter obtained from the particle-diameter distribution based on the number of toner particles is equal to about 7 μm while the average particle diameter obtained from the particle-diameter distribution based on the volume is equal to about 8 μm. It is difficult to manufacture such uniform toner by a general grinding method, and polymerized toner, which is manufactured by a dispersion polymerization method, a solution polymerization method or a suspension polymerization method, is preferably used. In the above description, the particle-diameter distribution based on the volume is substantially identical to the particle-diameter distribution based on the weight.

The toner supply roller 12, the toner carry roller 14, the toner withdrawing roller 15 and the agitator 17 are supported by the toner case 11 so as to be rotatable in directions as indicated by arrows (FIG. 1) and disposed parallel to one another. The carry roller 14, both the toner carry roller 14 and the toner supply roller 12 and both the toner carry roller 14 and the toner withdrawing roller 15 are disposed in contact with each other, respectively. The toner-layer restricting blade 18 is pressed against the carry roller 14 and serves to adjust the toner so that the amount of the toner 16 carried on the carry roller 14 is a single uniform layer on the roller surface and also to charge the toner 16 uniformly. The withdrawing blade 19 is disposed in contact with the tip of the brush of the withdrawing roller 15, and by rotation of the withdrawing roller 15, the toner attached to the brush is peeled off by the withdrawing blade 19, falling into the toner sink 21.

Figure 2:
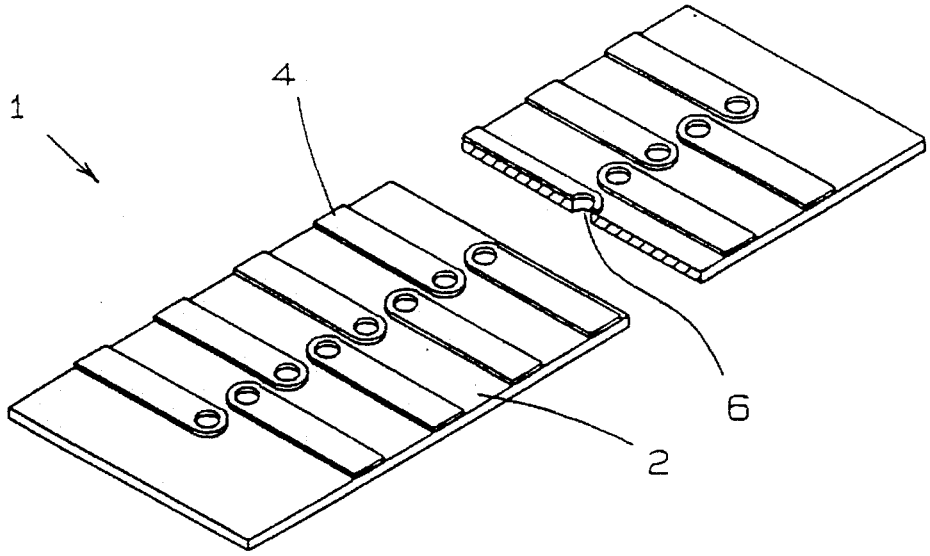
FIG. 2 is a perspective view showing the construction of an aperture electrode unit used in the image forming apparatus.

As shown in FIG. 2, the aperture electrode unit 1 comprises a polyimide insulating sheet 2 of about 25 μm thickness in which plural apertures 6 each having a diameter of about 100 μm are formed in a row, and control electrodes 4 each having about 1 μm thickness are formed on the upper surface of the insulating sheet 2 in correspondence with each aperture 6. In operation, the aperture electrode unit I is pressed against the carry roller 14 at the aperture position of the insulating sheet 2, and the control electrodes 4 face the image receiving medium 20 as showing FIG. 1.

The detailed positional relationship between the apertures 6 of the aperture electrode unit 1 and the carry roller 14 will be described.

Figure 3:
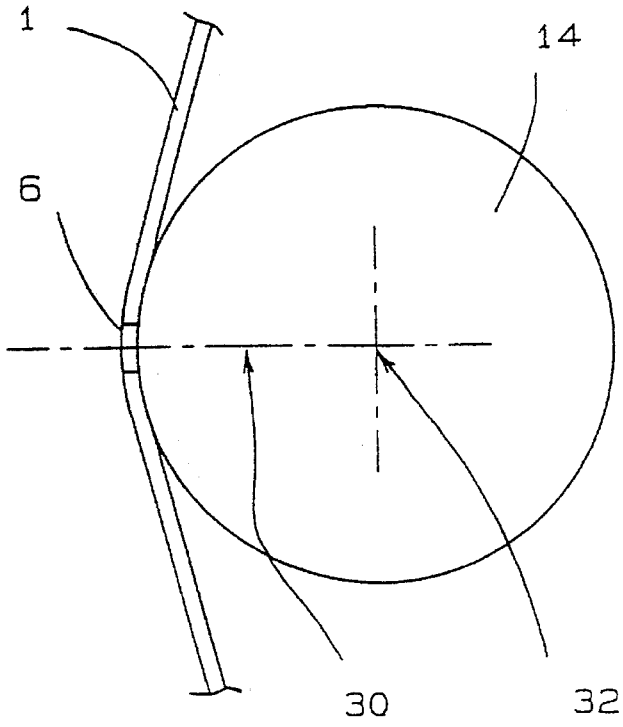
FIG. 3 is a schematic view showing the construction of an aperture electrode unit and a carry roller used in the image forming apparatus.

As shown in FIG. 3, each aperture 6 is disposed so that the center axis 30 thereof passes through the leftmost portion of the peripheral surface of the carry roller 14 and the center axis 32 of the carry roller 14. With this arrangement, each aperture 6 is disposed uniformly with reference to the peripheral surface of the carry roller 14, whereby the distribution of the toner 16 passing through each aperture 6 can be made uniform over the whole area in the aperture. Further, the wall surface of the aperture 6 and the flight (supply) direction of the toner 16 are substantially parallel to each other, so that the toner 16 can be stably supplied.

The aperture electrode unit 1 is pressed against the carry roller 14 so as to be bent toward the carry roller 14 by the same angle with the aperture 6 at the center. With this Construction, the contact area between the aperture electrode unit 1 and the toner carry roller 14 can be increased, and the lower peripheral portion of each aperture 6 can be pressed uniformly at the upper and lower sides, so that occurrence of unevenness in toner density can be suppressed.

A control voltage applying circuit 8 is connected across the control electrodes 4 and the toner carry roller 14. The control voltage applying circuit serves to apply a voltage of 0 V or +50 V to the control electrodes 4 in accordance with an image signal. In addition, a DC power source 24 is connected across the back electrode plate 22 and the toner carry roller 14. The DC power source 24 serves to apply a voltage of +1 kV to the back electrode plate 22.

Next, the operation of the image forming apparatus thus constructed will be described.

First, through the rotation of the agitator 17, the supply roller 42 and the toner carry roller 14 in the directions as indicated by the arrows in FIG. 1, the toner 16 in the toner sink 21 adheres to the supply roller 12, and the toner 16 adhering to the supply roller 12 is rubbed against and carried by the carry roller 14. The carried toner 16 is thinned by the toner-layer restricting blade 18 and charged negatively, and thereafter, it is fed toward the aperture electrode unit 1 by the rotation of the carry roller 14. The toner 16 on the carry roller 14 is supplied to the apertures 6 while being rubbed against the insulating sheet 2 of the aperture electrode unit 1.

At this time, a voltage of +50 V is applied from the control voltage applying circuit 8 to the control electrodes 4 corresponding to an image portion in accordance with an image signal. As a result, an electric force from the control electrodes 4 to the toner carry roller 14 is formed in the vicinity of the apertures 6 corresponding to the image portion by the potential difference between the control electrodes 4 and the toner carry roller 14. Accordingly, an electrostatic force toward the higher potential side is applied to the negatively charged toner, so that the toner is electrostatically attracted from the surface of the toner carry roller 14 through the apertures 6 to the control electrodes 4 side. The attracted toner 16 is further attracted toward the image receiving medium 20 by an electric field that is generated between the image receiving medium 20 and the aperture electrode unit 1 due to the voltage applied to the back electrode plate 22. This further attraction enables the toner 16 to be deposited on the image receiving medium 20, thereby forming an image on the image receiving medium 20. As described above, since the uniform toner 16 is supplied as a single layer to the apertures 6, sufficient electrostatic attraction can be obtained with a driving voltage of 50 V as shown by a solid line of FIG. 4A.

For a non-image portion, i.e., off-time, a voltage of 0 V is applied from the control voltage applying circuit 8 to the control electrodes 4. As a result, no electric field occurs between the toner carry roller 14 and the control electrodes 4, and thus, no electrostatic force is applied to the toner 16 on the toner carry roller 14. As a result, the toner is not passed through the apertures 6.

The image receiving medium 20 is fed in the direction substantially perpendicular to the aperture array by a distance corresponding to one pixel while a line (row) of an image is formed on the image receiving medium 20 with the toner 16. By repeating the above process, a toner image can be formed on the surface of the image receiving medium 20. Thereafter, the toner image thus formed is fixed on the image receiving medium 20 by the fixing device 26 including a pressure roller 26A and a heating roller 26B.

The toner that is not past through the apertures 6 and remains on the carry roller 14 is scratched off by the brush of the withdrawing roller 15 and adheres to the brush. The toner adhering to the brush is withdrawn by the withdrawing blade 19 into the toner sink 21. The toner withdrawn in the toner sink 21 is mixed with unused toner and stirred by rotation of the agitator 17.

As described above, the toner is prevented from remaining on the toner carry roller 14 and circulated in the apparatus at all times, so that the toner can be prevented from being deteriorated due to frictional heat. Further, the toner that is once charged on the toner carry roller 14 is naturally discharged through the withdrawal, and its charge characteristic is easily controlled when it is next used.

In this embodiment, the arrangement of the respective elements is ideal. That is, the toner supply roller 12, the toner-layer restricting blade 18, the aperture electrode unit I and the withdrawing roller 15 are disposed in this order from the upstream side of the toner feeding path of the toner carry roller 14, and the toner-layer restricting blade 18, the toner supply roller 12 and the withdrawing roller 15 are disposed at one side of the toner carry roller 12 in this order from the upper side in the gravity direction. Surplus toner occurring in the toner-layer restricting blade 18 falls into the toner supply roller by gravitational force. Advantageously, toner that passes through the gap between the toner supply roller 12 and the toner carry roller 14 also falls into the toner withdrawing roller 15. The toner on the withdrawing roller 15 is withdrawn into the toner sink 21 by the withdrawing blade 19. In order to suppress the deterioration of the toner, the outline of the toner supply roller 12 or the like is adjusted so that the surplus toner generated by the toner-layer restricting blade 18 can be prevented from being trapped above a contact portion between the toner carry roller 14 and the toner supply roller 12, and the surplus toner is liable to fall into the withdrawing roller 15.

Moreover, the toner circulation that is performed at the right side of the toner carry roller 14 (in FIG. 1) causes no contamination of surplus toner into the aperture electrode unit 1 at the left side of the toner carry roller 14, and sealing of the apparatus is easily accomplished.

If insulating toner is used in the image forming apparatus thus constructed, the insulation between the toner carry roller 14 and the control electrodes 4 is maintained, and the apertures 6 can be prevented from being broken down.

In the above process, the control electric field formed by the control electrodes 4 is formed inside of the control electrodes 4 and the apertures 6 and between the apertures 6 and the toner carry surface of the toner carry roller 14, which is facing the apertures 6, and thus, the control electric field can be directly applied to the carried toner 16, so that control efficiency can be improved.

Even when a part of the supplied toner 16 is subject to a mechanical force or the like through the sliding motion between the toner 16 and the aperture electrode unit 1, causing the toner to move into the apertures 6 corresponding to a non-image portion, the toner can be prevented from being past through the apertures 6 by the electric field occurring in the apertures 6, so that high controllability of the toner is obtained.

In addition, the toner carry roller 14 and the aperture electrode unit 1 are disposed so as to be facing each other through the toner layer, and thus, these elements can be disposed a relatively short distance from each other. Accordingly, the control voltage can be reduced, and inexpensive drive elements can be used.

Moreover, the insulating sheet 2 of the aperture electrode unit 1 is disposed facing the toner carry roller 14. Accordingly, even in a case where no toner 16 exists on the toner carry roller 14 because of some failure of the toner supply system, contact between the control electrodes 4 and the toner carry roller 14, which would cause a short-circuit of these elements, can be prevented, and the driving elements can be prevented from being broken down.

Further, the aperture electrode unit 1 and the toner 16 on the toner carry roller 14 contact each other at the inlet ports of the apertures, and thus, the toner that is deposited at the inlet ports of the apertures 6 is pushed out by the toner that is successively supplied from the toner carry roller 14, so that clogging of the apertures 6 due to deposition and bridging of the toner 16 does not occur.

Next, a manufacturing method of manufacturing toner whose degree of dispersion is set in the range of 1.0 to 1.15 will be described.

EXAMPLE

| | |
|---|---|
| polyvinyl pyrrolidone K-30 | 24.0 g |
| 1-hexadecanol | 6.0 g |
| methanol | 465.6 g |
| isopropyl alcohol | 116.4 g |
| styrene | 166.0 g |
| n-butyl acrylate | 34.0 g |

The materials as described above were mixed with each other in the respective amounts as described above, and the mixture was heated to 60° C. and purged (replaced) at 60° C. for one hour while supplying nitrogen gas. Thereafter, the temperature of the mixture was reduced to 40° C., and the mixture was added with α,α'-azobisisobutyronitrile of 6.0 g as a polymerization initiator. The mixture was heated to 60° C. again and polymerized at 60° C. for about 13 hours. As a result, the average particle diameter obtained from the particle-diameter distribution on the basis of the volume (volume average particle diameter) was 3.9 μm, and the average particle diameter obtained from the particle-diameter distribution on the basis of the number of toner particles (number average particle diameter) was 3.8 μm. These average particle diameters were measured by a multi-sizer II of Coal Tar Company. The degree of dispersion, was 1.04.

Figure 4A:
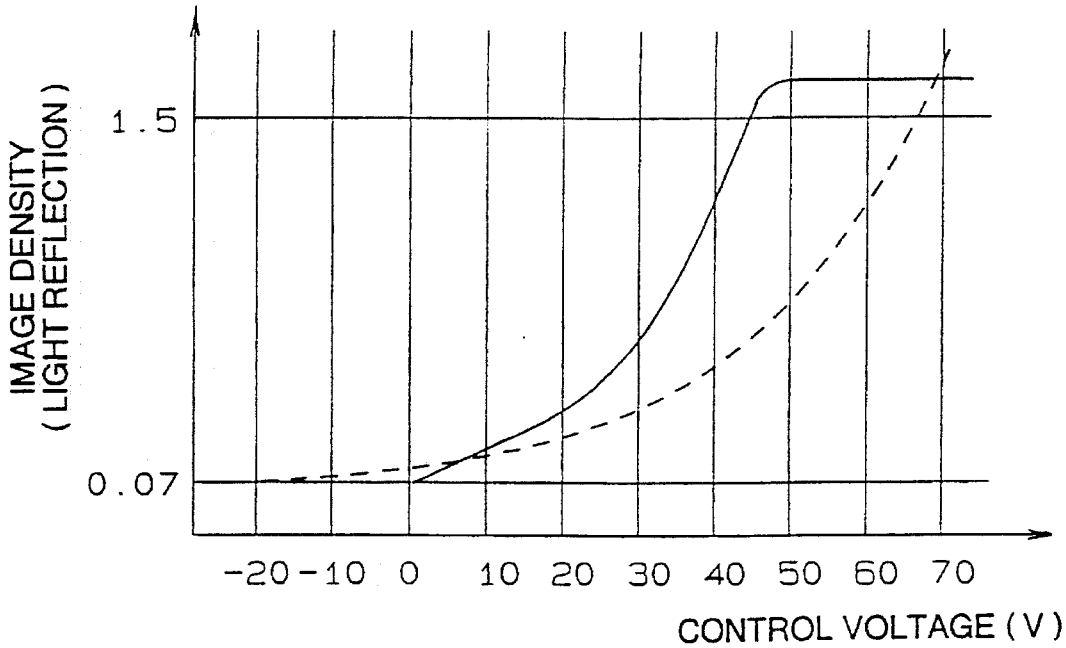
FIG. 4A is a graph showing voltage controllability of an image density in the image forming apparatus.
Figure 4B:
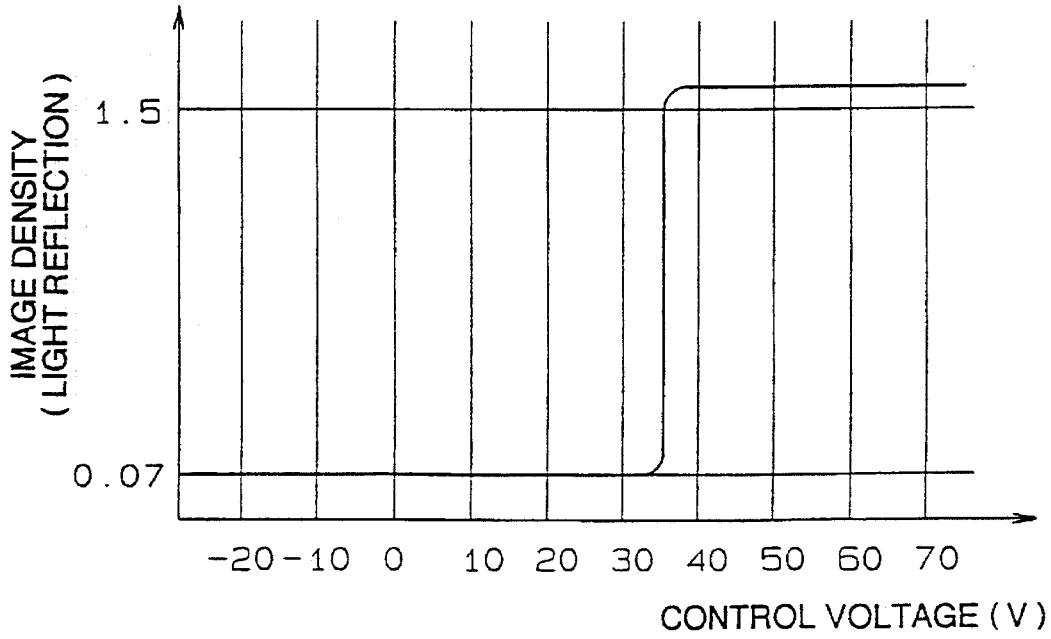
FIG. 4B is a graph showing the ideal controllability of the image density in the image forming apparatus.
Figure 6:
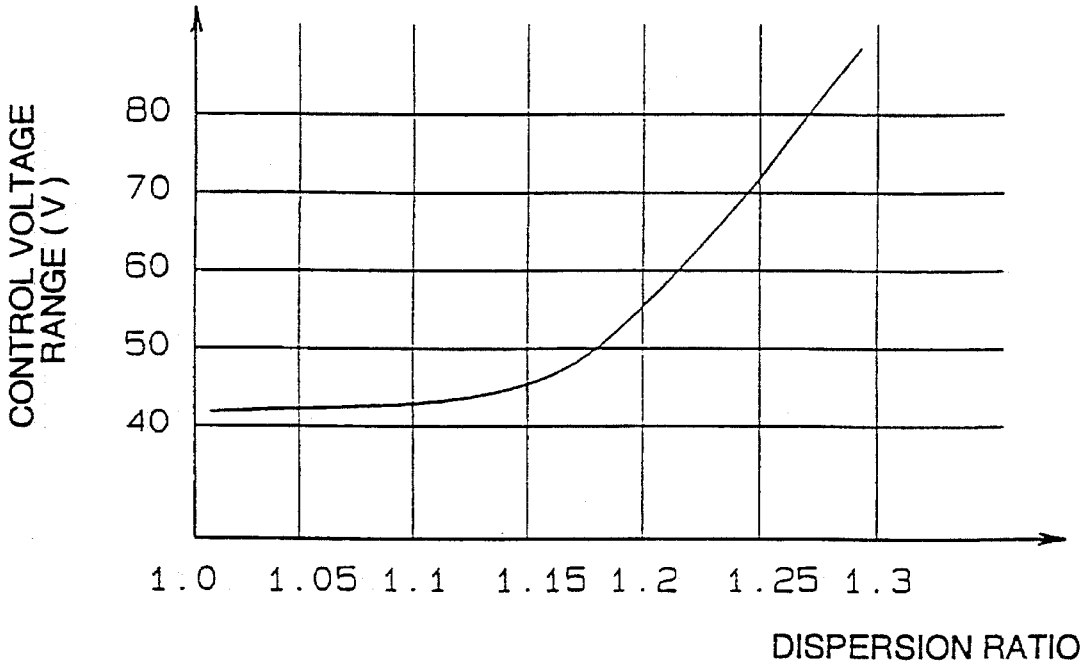
FIG. 6 is a graph showing the relationship between a dispersion ratio of toner and a control voltage range of the toner used in the image forming apparatus.
Figure 7:
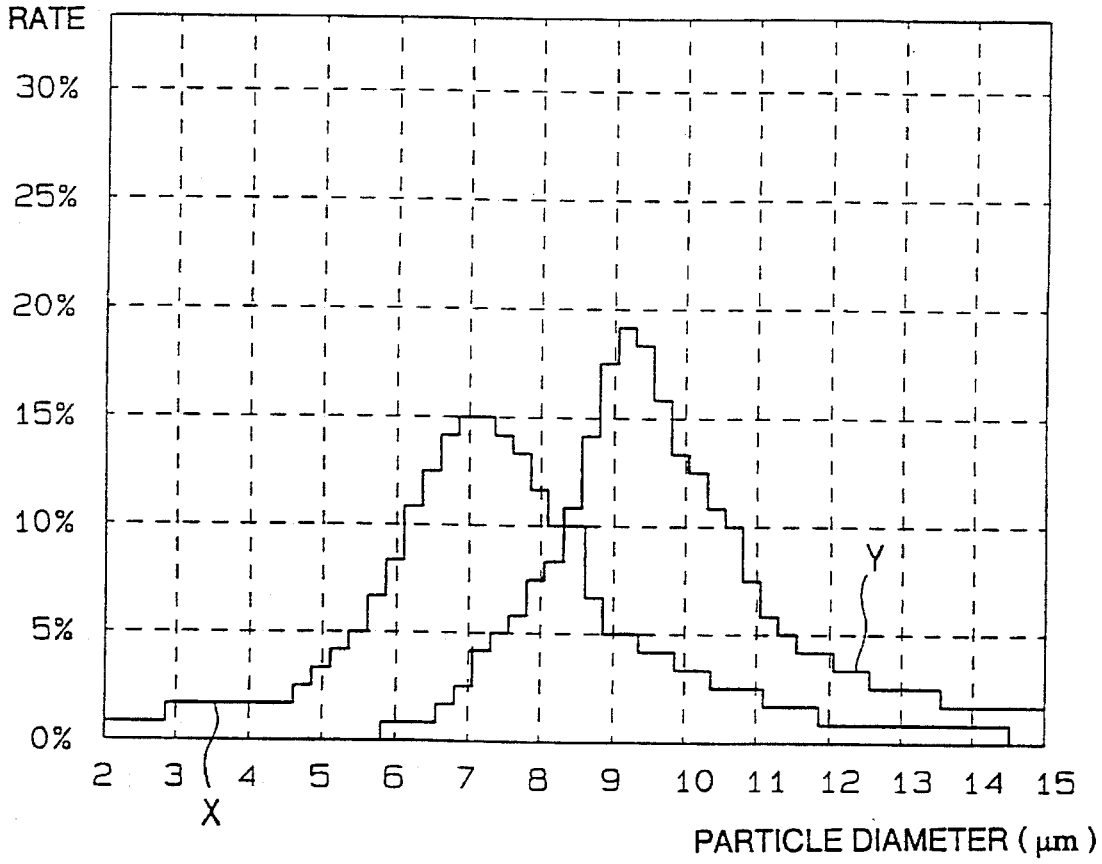
FIG. 7 is a graph showing a particle diameter distribution of the toner used in the image forming apparatus.

As shown in FIG. 6, if the degree of dispersion is equal to 1.15 or less (1.0 to 1.15), the control voltage range (the variation of the control voltage between the on-time and the off-time to obtain contrast of image density of 0.07 to 1.5 in FIG. 4A) can be reduced to 50 V or less. If the degree of dispersion is in the range of 1.0 to 1.15, the control voltage at the on and off times can be set as indicated by a solid-line of FIG. 4A.

Further, when toner whose degree of dispersion is 1.0 to 1.15 is used and it is carried as a single layer on the toner carrier even slight fog can be prevented from occurring at a non-image portion. This is because if the uniform toner is carried as a single layer on the toner carrier, the adhering force of the toner to the toner carrier is made remarkably uniform.

This invention is not limited to the embodiment as described above, and various modifications may be made without departing from the scope of this invention.

For example, in the above embodiment, the control voltage for the apertures corresponding to the non-image portion is set to 0 V, however, it may be set to a negative voltage. In this case, an image can be obtained with even less fog. Further, in the above embodiment, the aperture electrode unit is used as the toner flow control means. However, a mesh type electrode unit as disclosed in U.S. Pat. No. 5,036,341 for example may be used.

Further, in the above embodiment, the brush-type withdrawing roller 15 is used as means of withdrawing the residual toner on the toner carry roller 14. However, the withdrawing means is not limited to the above embodiment, and silicon rubber having high adhesiveness or the like may be used. Further, the residual toner may be peeled off by a resin blade of urethane. In this case, it is necessary that a part like the withdrawing roller 15 used in the embodiment is disposed below the resin blade, and the exfoliated toner is withdrawn into the toner sink 21.

What is claimed is:

1. An image forming apparatus comprising:

toner flow control means for controlling a flow of charged toner particles; and toner supply means for supplying toner particles to said toner flow control means, wherein a degree of dispersion of the toner is set in a range of 1.0 to 1.15, the degree of dispersion being defined as a value that is obtained by dividing an average particle diameter obtained from a particle-diameter distribution on the basis of toner volume by an average particle diameter obtained from a particle-diameter distribution on the basis of toner particle number.

2. The image forming apparatus as claimed in claim 1, wherein said toner supply means comprises a toner carrier for carrying the toner particles thereon as a single layer and for supplying the single layer to said toner flow control means.

3. The image forming apparatus as claimed in claim 2, wherein said toner supply means comprises a restricting blade disposed against said toner carrier.

4. The image forming apparatus as claimed in claim 3, wherein said restricting blade forms a single toner layer on said toner carrier and comprises means for uniformly charging the single toner layer.

5. The image forming apparatus as claimed in claim 2, wherein said toner flow control means comprises an electrode unit, and wherein said toner carrier carries said toner to said electrode unit.

6. The image forming apparatus as claimed in claim 5, wherein said electrode unit comprises:

an insulating sheet having a plurality of apertures formed in a row therein; and a corresponding plurality of control electrodes formed on a first surface of said insulating sheet, wherein a second surface of said electrode unit is disposed against said toner carrier such that said apertures are adjacent said toner carrier.

7. The image forming apparatus as claimed in claim 6, wherein said apertures are disposed uniformly with respect to a peripheral surface of said toner carrier.

8. The image forming apparatus as claimed in claim 6, wherein said electrode unit is bent around said toner carrier.

9. The image forming apparatus as claimed in claim 6, wherein said electrode unit further comprises:

a back electrode plate disposed a predetermined distance from said control electrodes and coupled to a power source; and a control voltage applying circuit coupled to said control electrodes, said control voltage applying circuit applying a voltage to the control electrodes in accordance with an image signal.

10. The image forming apparatus as claimed in claim 9, wherein said predetermined distance is about 1 mm.

11. The image forming apparatus as claimed in claim 9, wherein said power source applies a first voltage to said back electrode, and wherein said control voltage applying circuit selectively applies a second voltage lower than said first voltage and a third voltage lower than said second voltage to said control electrodes in accordance with said image signal.

12. The image forming apparatus as claimed in claim 1, wherein said toner flow control means comprises one of an aperture electrode unit and a mesh electrode unit.

13. An image forming apparatus comprising:

an electrode unit that controls a flow of charged toner particles; and a toner supply system for supplying toner particles to said electrode unit, wherein a degree of dispersion of the toner is set in a range of 1.0 to 1.15, the degree of dispersion being defined as a value that is obtained by dividing an average particle diameter obtained from a particle-diameter distribution on the basis of toner volume by an average particle diameter obtained from a particle-diameter distribution on the basis of toner particle number.

14. The image forming apparatus as claimed in claim 13, wherein said toner supply system comprises:

a toner sink housing toner;

a toner supply roller communicating with said toner sink; and a toner carry roller disposed adjacent said toner supply roller, said toner supply roller carrying toner to said toner carry roller.

15. The image forming apparatus as claimed in claim 14, wherein said toner supply system further comprises a restricting blade disposed against said toner carry roller.

16. The image forming apparatus as claimed in claim 15, wherein said restricting blade forms a single toner layer on said toner carry roller and comprises means for uniformly charging the single toner layer.

17. The image forming apparatus as claimed in claim 14, wherein said toner carry roller carries said toner to said electrode unit.

18. The image forming apparatus as claimed in claim 17, wherein said electrode unit comprises:

an insulating sheet having a plurality of apertures formed in a row therein; and a corresponding plurality of control electrodes formed on a first surface of said insulating sheet, wherein a second surface of said electrode unit is disposed against said toner carry roller such that said apertures are adjacent said toner carry roller.

19. The image forming apparatus as claimed in claim 18, wherein said electrode unit further comprises:

a back electrode plate disposed a predetermined distance from said control electrodes and coupled to a power source; and a control voltage applying circuit coupled to said control electrodes, said control voltage applying circuit applying a voltage to the control electrodes in accordance with an image signal.

20. The image forming apparatus as claimed in claim 19, wherein said power source applies a first voltage to said back electrode, and wherein said control voltage applying circuit selectively applies a second voltage lower than said first voltage and a third voltage lower than said second voltage to said control electrodes in accordance with said image signal.

21. An image forming method using an electrode unit, the method comprising:

controlling a flow of charged toner particles;

supplying toner particles to said electrode unit; and setting a degree of dispersion of the toner in a range of 1.0 to 1.15, the degree of dispersion being defined as a value that is obtained by dividing an average particle diameter obtained from a particle-diameter distribution on the basis of toner volume by an average particle diameter obtained from a particle-diameter distribution on the basis of toner particle number.

* * * * *